US007377316B2

(12) United States Patent
Boyd

(10) Patent No.: US 7,377,316 B2
(45) Date of Patent: May 27, 2008

(54) SIDE ENTRY APPARATUS AND METHOD

(76) Inventor: Anthony R. Boyd, 1907 Vida Shaw Rd., New Iberia, LA (US) 70563

( * ) Notice: Subject to any disclaimer, the term of this patent is extended or adjusted under 35 U.S.C. 154(b) by 152 days.

(21) Appl. No.: 11/305,055

(22) Filed: Dec. 16, 2005

(65) Prior Publication Data

US 2007/0137867 A1 Jun. 21, 2007

(51) Int. Cl.
*E21B 19/00* (2006.01)

(52) U.S. Cl. ..... 166/242.5; 166/77.1; 166/385; 175/321

(58) Field of Classification Search ..... 166/242.5, 166/385, 77.1; 175/74, 51, 321
See application file for complete search history.

(56) References Cited

U.S. PATENT DOCUMENTS

RE33,150 E 1/1990 Boyd
5,996,712 A 12/1999 Boyd
6,244,345 B1 6/2001 Helms
7,104,345 B2 * 9/2006 Eppink ..... 175/61

* cited by examiner

*Primary Examiner*—Giovanna C Wright
(74) *Attorney, Agent, or Firm*—Robert L. Waddell; Ted M. Anthony

(57) ABSTRACT

An apparatus for lowering wireline into a well. The apparatus comprises a sleeve having a first and second end, wherein the first end contains a first plurality of wedges and the second end contains a second plurality of wedges. The apparatus further includes an upper mandrel having a third plurality of wedges that are configured to engage the first plurality of wedges and a first cap configured to engage the upper mandrel, wherein the first cap contains a first and second passage, and wherein the first passage is configured to receive the wireline. The apparatus further comprises a lower mandrel having a fourth plurality of wedges that engage with the second plurality of wedges, and a second cap configured to engage the lower mandrel, wherein the second cap contains an opening that has the lower mandrel disposed there through.

14 Claims, 3 Drawing Sheets

SIDE ENTRY APPARATUS AND METHOD

BACKGROUND OF THE INVENTION

This invention relates to a side entry apparatus. More particularly, but not by way of limitation, this invention relates to a side entry apparatus used to channel wireline into a well and a method of use.

During the exploration, drilling, completion and production of hydrocarbons, operators find it necessary to perform wireline work within the well. In most instances, an operator will rig up a lubricator, and wherein the lubricator is attached to the well head. The lubricator is a tubular member that contains a central passage for the conveyance of other concentric tubulars, wireline, electric line, braided line, drilling fluids, completion fluids, etc. The lubricator may contain certain devices such as valves, blow out preventor stacks, swivels, etc. as is well understood by those of ordinary skill in the art.

U.S. Pat. No. RE 33,150 to Boyd describes a side entry tool and is incorporated herein by reference. The side entry tool is a device that can be contained within a lubricator and may contain a central passage for tools, fluid, etc. The side entry tool will also contain a second passage, and wherein the second passage allows entry of a wireline for purposes of conducting wireline operations.

When an operator wishes to rig up a lubricator string, the operator must threadedly make up the connections. A torque is applied via conventional means. However, in the course of applying the torque, some connections may become over torqued. As understood by those of ordinary skill in the art, the application of too much torque can cause damage to the threads, tubular and/or tool, which in turn may lead to failure of the connection and/or tool. The failure may occur at the rotary floor. These types of failures may result in catastrophic effects such as a blowout of the well.

Therefore, there is a need for a device that contains a second passageway. There is also a need for a device that will allow for the proper make up of a lubricator string on a rig. There is also a need for device that will prevent over-torquing of side entry tools. These and other needs will be met by the disclosure herein presented.

SUMMARY OF THE INVENTION

An apparatus for lowering wireline into a well is disclosed. The apparatus comprises a sleeve having a first end and a second end, and wherein the first end contains a first plurality of wedges and a second plurality of wedges. The apparatus further comprises an upper mandrel having a third plurality of wedges that are configured to engage the first plurality of wedges. The apparatus further includes a first cap configured to engage the upper mandrel, wherein the first cap contains a first passage and a second passage, and wherein the first passage is configured to receive the wireline. The apparatus further comprises a lower mandrel having a fourth plurality of wedges that engage with the second plurality of wedges, and a second cap configured to engage the lower mandrel, wherein the second cap contains an opening, and wherein the opening has the lower mandrel disposed there through. In one preferred embodiment, the upper mandrel has a center of axis that is aligned with the center of axis of the sleeve bore. Also, the upper mandrel is configured to provide for a center of pull of the apparatus.

In one preferred embodiment, the apparatus includes thread means on the inner portion of the first cap and thread means on the outer sleeve which cooperate. The apparatus may also comprise thread means on the inner portion of the second cap and thread means on the outer sleeve which cooperate. In one preferred embodiment, the apparatus further includes seal means on the inner portion of the sleeve, a cooperating seal bore on the upper mandrel, seal means on the inner portion of the sleeve, and a cooperating seal bore on the lower mandrel. In the most preferred embodiment, the second passage is configured to receive a kill line means for pumping a fluid into the well. In another preferred embodiment, the second passage is configured to receive a second wireline extending into the well.

A method of performing wireline work on a rig, wherein a well extends from the rig, is also disclosed. The method comprises providing an apparatus comprising: a sleeve having a first second end, wherein the first end contains a first plurality of wedges and the second end contains a second plurality of wedges; an upper mandrel having a third plurality of wedges that are configured to engage the first plurality of wedges; a first cap configured to engage the upper mandrel, wherein the first cap contains a first and second passage, and wherein the first passage is configured to receive the wireline; a lower mandrel having a fourth plurality of wedges that engage with the second plurality of wedges; a second cap configured to engage the lower mandrel, wherein the second cap contains an opening that has the lower mandrel disposed there through. The method further includes providing a wireline through the first passage and into a central bore of the sleeve, and wherein the wireline has a down hole tool attached at a first end, wherein the down hole tool is in the well. The method further comprises lowering the down hole tool on the wireline into the well, transmitting a torque to the upper mandrel, transmitting the torque to the third plurality of wedges and transferring the torque to the first plurality of wedges. In one preferred embodiment, the method further includes terminating the torque to the upper mandrel, transmitting the torque to the lower mandrel, transmitting the torque to the fourth plurality of wedges, transferring the torque to the second plurality of wedges. The method may include pumping a fill fluid through the second passage and into the well.

An advantage of the present invention is that the apparatus will prevent the over torquing of a tubular. Another advantage is that the apparatus can be used as a side entry tool on a rig drilling a well. Yet another advantage is that the invention allows a significant amount of torque be applied to the apparatus without damaging the apparatus. Still yet another advantage is that the apparatus will result in safer connections since the connections will not be over torqued. Another advantage is that the torque is transferred on the outside body.

A feature of the present invention includes the torque shoulders on the body portion will engage and cooperate with torque shoulders on the bottom sub portion. Another feature is that the torque is applied only to the torque shoulders. Another feature is that multiple apertures may be provided on the upper cap for multiple entry points for multiple wirelines, kill lines, etc. Yet another feature is that the central passage can contain a large flow through bore. Yet another feature is that the wireline will pass on the inside of the seal o-rings and torquing areas. Still yet another feature includes the ability to center pull on the mandrel while the apparatus is in use on a rig floor. Yet another feature is the seal means contain the pressure from the well.

BRIEF DESCRIPTION OF THE INVENTION

DETAILED DESCRIPTION OF THE PREFERRED EMBODIMENTS

Figure 1:
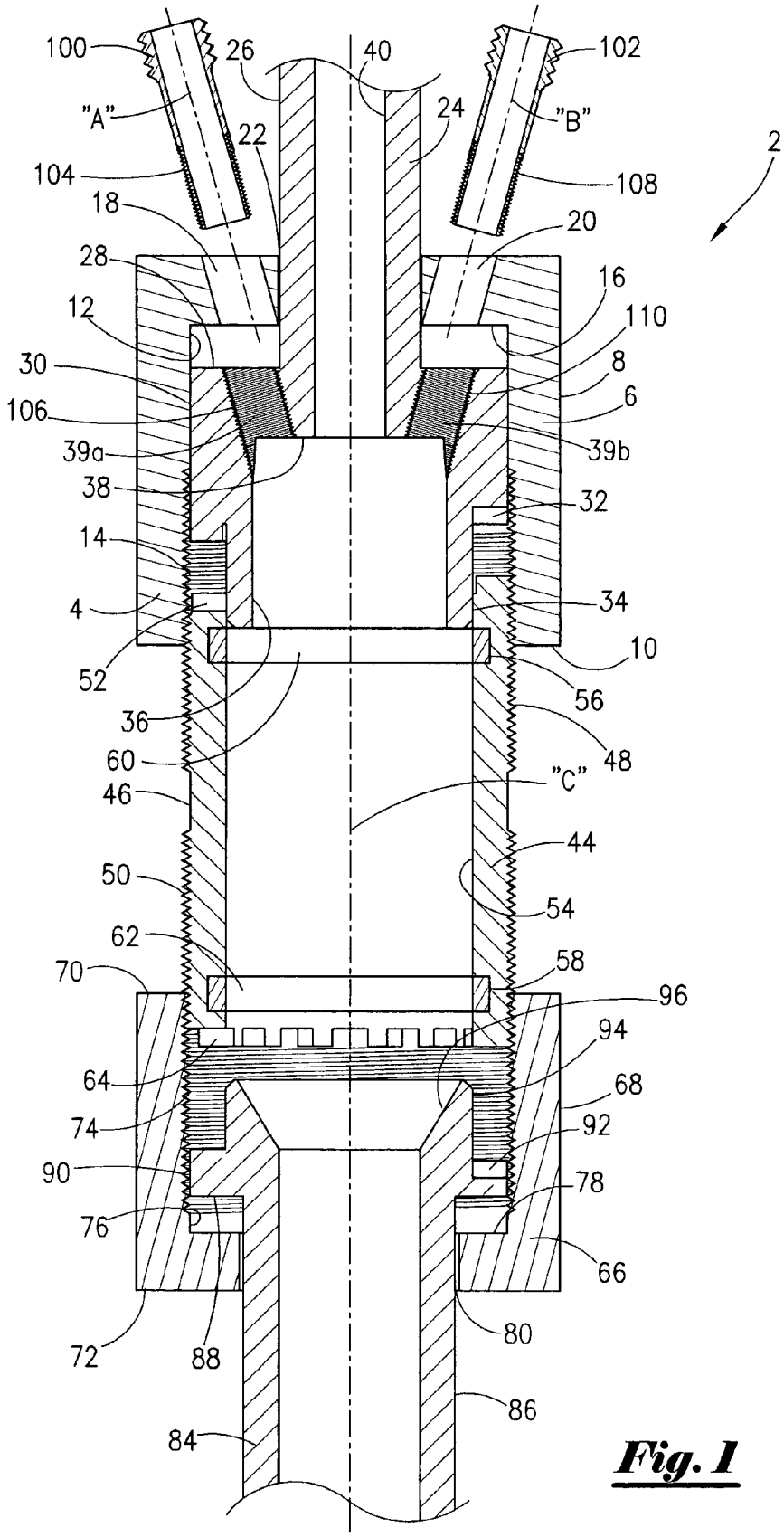
FIG. 1 is a partially exploded cross-sectional view of the most preferred embodiment of the present invention.

Referring now to FIG. 1, a partially exploded cross-sectional view of the most preferred embodiment of the present invention will now be described. More specifically, the apparatus 2 includes a first cap 4, wherein the first cap 4 includes a cylindrical body 6 that has an outer cylindrical surface 8 that extends to the radial end 10, and wherein the radial end 10 in turn extends to the inner diameter surface 12. The inner diameter surface 12 includes the inner thread means 14, and wherein the inner diameter surface 12 extends to the end surface 16. As shown in FIG. 1, the end surface 16 has two (2) passages bored there through, namely passage 18 and passage 20. The center axis for passage 18 is shown as "A" and the center axis for passage 20 is shown as "B". Passages 18, 20 are configured at an angle relative to the center axis "C" of the first cap 4. FIG. 1 further depicts a center opening 22, and wherein a mandrel 24 is disposed within center opening 22. As seen in FIG. 1, the line "C" also serves as the center of axis for the mandrel 24 (i.e. sharing of the center axis "C).

The mandrel 24 comprises a generally cylindrical outer surface 26 that extends to a radial surface 28 which in turn extends to the outer cylindrical surface 30. The outer cylindrical surface 30 terminates at the plurality of wedge members 32, which in turn extends to the outer cylindrical surface 34. The mandrel 24 contains an inner diameter portion 36 which extends to the radial surface 38, and wherein the radial surface 38 contains the passages 39*a*, 39*b* that are aligned with the passages 18, 20. The radial surface 38 extends to the inner diameter surface 40.

The sleeve 44 contains an outer cylindrical surface 46, and wherein the outer cylindrical surface 46 contains the outer thread means 48 as well as the outer thread means 50. The outer thread means 48 will cooperate and mate with the inner thread means 14. The thread means 48 extend to the plurality of wedge members 52, and wherein the wedge members 52 cooperate and engage with the wedge members 32. The term wedges, in the most preferred embodiment, refers to square teeth type of protrusions that will cooperate and engage with a set of complimentary teeth. In one embodiment, the wedges may be a torque shoulder that transfers torque to a complimentary torque shoulder.

The sleeve 44 contains an inner diameter surface 54 that contains a first groove 56 and a second groove 58, and wherein the first groove 56 contains a v-packing element (seal means 60) and the second groove 58 contains a v-packing element (seal means 62). An o-ring type of seal means could also be used. The seal means 60 will sealingly engage with the outer cylindrical surface 34. The sleeve 44 further comprises at a radial end, the plurality of wedges 64.

In the most preferred embodiment, the apparatus 2 further comprises a second cap 66 that includes an outer cylindrical surface 68. The second cap 66 contains a first radial end 70 and a second radial end 72. Extending radially inward from the first radial end 70 is the internal thread means 74 that will cooperate and engage outer thread means 50. The second cap 66 includes the inner diameter surface 76 which extends to the radial surface 78, and wherein the radial surface 78 contains the opening 80.

The apparatus 2 further comprises mandrel 84 that includes the outer cylindrical surface 86. The outer cylindrical surface 86 extends to the radial shoulder 88 which stretches to the outer surface 90. The mandrel 84 contains a plurality of wedges 92, and wherein the wedges 92 will cooperate and engage with the wedges 64. The wedges 92 has extending therefrom the outer cylindrical surface 94. Extending radially inward from the outer cylindrical surface 94 is the inner chamferred surface 96. The outer cylindrical surface 94 will cooperate and sealingly engage with the seal means 62.

As seen in FIG. 1, a wireline guide sub 100 is provided for passages 18 and 39*a*, while the wireline guide sub 102 is provided for passages 20 and 39*b*. The wireline guide sub 100 contains the external thread means 104 for engagement with the internal thread means 106 within the passage 39*a* of mandrel 24. The wireline guide sub 102 contains the external thread means 108 for engagement with the internal thread means 110 within the passage 39*b* of mandrel 24.

Figure 2:
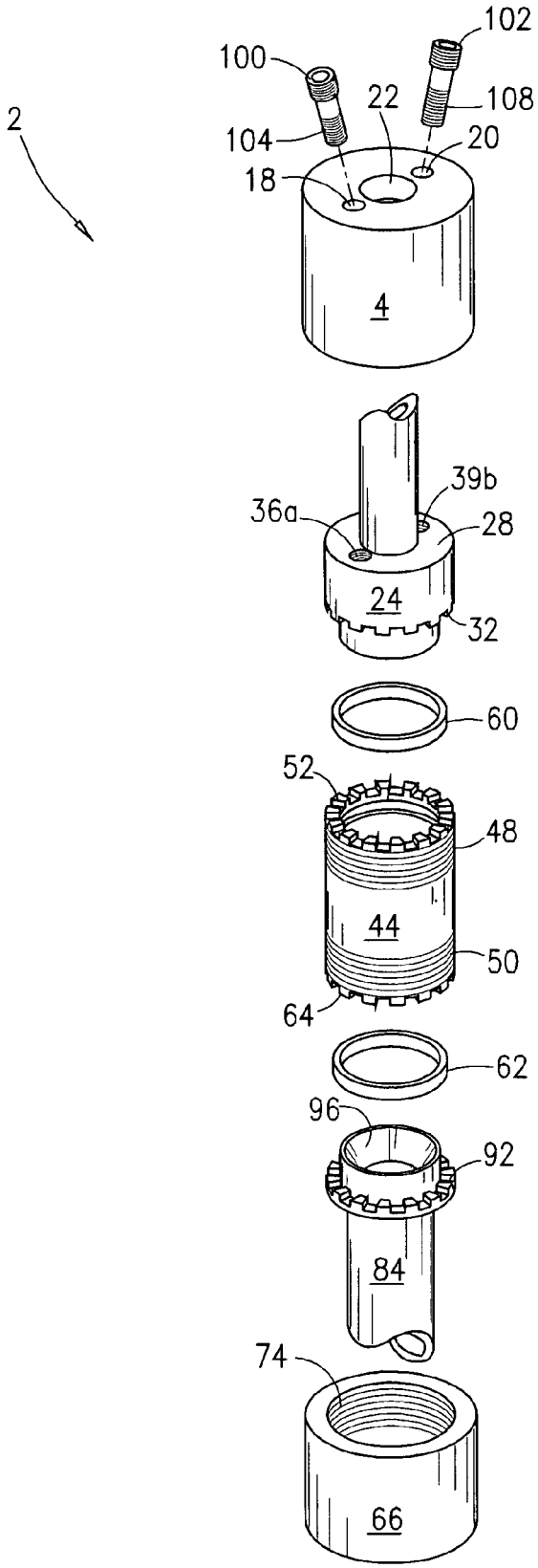
FIG. 2 is a fully exploded view of the cross-sectional embodiment seen in FIG. 1.

Referring now to FIG. 2, a fully exploded view of the cross-sectional embodiment seen in FIG. 1 will now be described. It should be noted that like numbers appearing in the various figures refer to like components. FIG. 2 shows the teeth like projections of the wedges, for instance wedges 32, 52, 64, 92.

Figure 3:
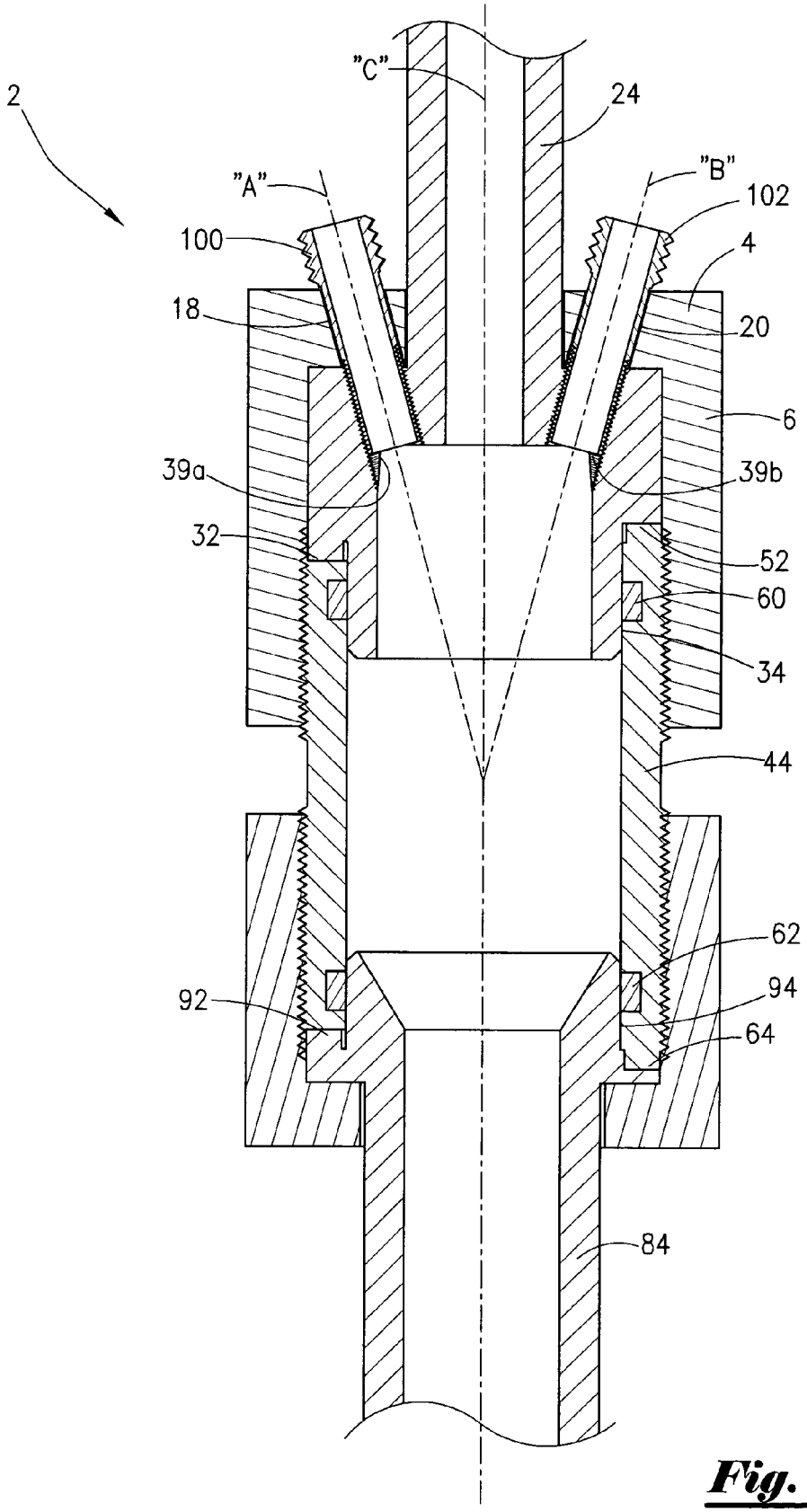
FIG. 3 is a cross-sectional assembled view of the embodiment depicted in FIG. 1.

FIG. 3 is a cross-sectional assembled view of the apparatus 2 depicted in FIG. 1. Therefore, FIG. 3 depicts the first cap 4 that has the cylindrical body 6. The mandrel 24 is disposed within the first cap 4, and wherein the wedges 32 are shown cooperating and engaging with the wedges 52. In this way, a torque applied to the mandrel 24 or the sleeve 44 will be transferred to the wedge profiles. Also, the first cap 4 holds the two together (mandrel 24 and sleeve 46), and keeps the wedges locked in place.

Also seen in FIG. 3 is the wedges 64 which are cooperating and engaging with the wedges 92 of the mandrel 84, and wherein a torque applied to the mandrel 84 will be transferred to the wedge profiles. FIG. 3 further depicts the outer cylindrical surface 34 sealingly engaging with the seal means 60, and the outer cylindrical surface 94 sealingly engaging with the seal means 62. FIG. 3 further depicts the center line "A" through passage 18 and into the inner portion of the sleeve 44, the center line "B' through passage 20, and the center line "C" through the bore of mandrel 24 and sleeve 44. It should be noted that in the case of pull force on the mandrel 24, the center of the pull force will be exerted on the mandrel about the center line "C". This is important because if an operator requires an axial pull force on the apparatus 2, the apparatus 2 will be balanced and the pull force can be distributed along the length of the mandrel 84 . . . .

As many possible embodiments may be made of the tool of this invention without departing from the scope thereof, or any equivalents thereof, it is to be understood that all matters herein set forth or shown in the accompanying drawings are to be interpreted as illustrated and not in a limiting sense.

I claim:

1. An apparatus for lowering a wireline into a well, the apparatus comprising:

a sleeve having a first end and a second end, wherein said first end contains a first plurality of wedges and the second end contains a second plurality of wedges;

an upper mandrel having a third plurality of wedges that are configured to engage the first plurality of wedges;

a first cap configured to engage the upper mandrel, wherein said first cap contains a first passage and a second passage, and wherein said first passage is configured to receive the wireline;

a lower mandrel having a fourth plurality of wedges that engage with the second plurality of wedges;

a second cap configured to engage the lower mandrel, wherein said second cap contains an opening, wherein said opening has the lower mandrel disposed there through;

thread means on an inner portion of the first cap;

thread means on an outer portion of the sleeve which cooperates with the thread means on the inner portion of the first cap.

2. The apparatus of claim 1 further comprising:

thread means on an inner portion of the second cap;

thread means on the outer portion of the sleeve which cooperate with the thread means on the inner portion of the second cap.

3. The apparatus of claim 2 further comprising:

first seal means on an inner portion of the sleeve;

a first cooperating seal bore on the upper mandrel for sealingly engaging the first seal means;

second seal means on the inner portion of the sleeve;

a second cooperating seal bore on the lower mandrel for sealingly engaging the second seal means.

4. The apparatus of claim 3 wherein said second passage is configured to receive a kill line means for pumping a fluid into the well.

5. An apparatus for lowering a wireline into a well, the apparatus comprising:

a sleeve having a first end and a second end, wherein said first end contains a first plurality of wedges and said second end contains a second plurality of wedges, said sleeve containing a bore having a center axis;

an upper mandrel having a third plurality of wedges that are configured to engage the first plurality of wedges, and wherein said upper mandrel has a center axis aligned with the center axis of said sleeve bore;

a first cap configured to engage the upper mandrel, wherein said first cap contains a first passage in communication with said bore and wherein said first passage is adapted to receive the wireline;

a lower mandrel having a fourth plurality of wedges that engage with the second plurality of wedges;

a second cap configured to engage the lower mandrel, wherein said second cap contains an opening, wherein said opening has the lower mandrel disposed there through;

first thread means on an inner portion of the first cap;

second thread means on an outer portion of the of sleeve which cooperates with the first thread means.

6. The apparatus of claim 5 further comprising:

third thread means on an inner portion of the second cap;

fourth thread means on the outer portion of the sleeve which cooperate with the third thread means.

7. The apparatus of claim 6 wherein said first cap contains a second passage in communication with said bore, and wherein said second passage is configured to receive a second wireline lowered into the well.

8. The apparatus of claim 7 further comprising:

first seal means on an inner portion of the sleeve;

a first cooperating seal bore on the upper mandrel for engaging with the first seal means.

9. The apparatus of claim 8 further comprising:

second seal means on the inner portion of the sleeve;

a second cooperating seal bore on the lower mandrel for engaging with the second seal means.

10. The apparatus of claim 7 wherein a center axis of said upper mandrel is aligned with the center axis of said sleeve so that said upper mandrel provides a center of pull for the apparatus.

11. An apparatus for lowering a wireline into a well, the apparatus comprising:

a sleeve having a first end and a second end, wherein said first end contains a first torque shoulder and the second end contains a second torque shoulder;

an upper mandrel having a third torque shoulder that is configured to engage the first torque shoulder;

a first cap configured to engage the upper mandrel, wherein said first cap contains a first passage and a second passage, and wherein said first passage is configured to receive the wireline;

a lower mandrel having a fourth torque shoulder that is configured to engage the second torque shoulder;

a second cap configured to engage the lower mandrel, wherein said second cap contains an opening, wherein said opening has the lower mandrel disposed there through;

first thread means on an inner portion of the first cap;

second thread means on an outer portion of the sleeve which cooperate with the first thread means on the inner portion of the first cap.

12. The apparatus of claim 11 wherein said second passage is configured to receive a kill line means for pumping a kill fluid into the well.

13. A method of performing wireline work on a rig, wherein a well extends from the rig, and wherein the method comprises:

providing an apparatus comprising: a sleeve having a first end and a second end, wherein said first end contains a first plurality of wedges and the second end contains a second plurality of wedges; an upper mandrel having a third plurality of wedges that are configured to engage the first plurality of wedges; a first cap configured to engage the upper mandrel, wherein said first cap contains a first passage and a second passage, and wherein said first passage is configured to receive the wireline; a lower mandrel having a fourth plurality of wedges that engage with the second plurality of wedges; a second cap configured to engage the lower mandrel, wherein said second cap contains an opening, wherein said opening has the lower mandrel disposed there through;

providing a wireline through said first passage and into a central bore of said sleeve, and wherein said wireline has a down hole tool attached at a first end, wherein the down hole tool is in the well;

lowering the down hole tool on the wireline into the well, transmitting a torque to the upper mandrel;

transmitting the torque to the third plurality of wedges;

transferring the torque to the first plurality of wedges.

14. The method of claim 13 further comprising:

terminating the torque to the upper mandrel;

transmitting the torque to the lower mandrel;

transmitting the torque to the fourth plurality of wedges;

transferring the torque to the second plurality of wedges;

pumping a fill fluid through the second passage and into the well.

* * * * *